US010865626B2

(12) United States Patent
Preiss et al.

(10) Patent No.: US 10,865,626 B2
(45) Date of Patent: Dec. 15, 2020

(54) HYDRAULIC UNDERBALANCE INITIATED SAFETY FIRING HEAD, WELL COMPLETION APPARATUS INCORPORATING SAME, AND METHOD OF USE

(71) Applicant: DynaEnergetics Europe GmbH, Troisdorf (DE)

(72) Inventors: Frank Haron Preiss, Bonn (DE); Eric Mulhern, Edmonton (CA)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 16/190,465

(22) Filed: Nov. 14, 2018

(65) Prior Publication Data

US 2019/0162058 A1 May 30, 2019

Related U.S. Application Data

(60) Provisional application No. 62/591,818, filed on Nov. 29, 2017.

(51) Int. Cl.
*E21B 43/1185* (2006.01)
*E21B 23/00* (2006.01)
*E21B 23/04* (2006.01)

(52) U.S. Cl.
CPC ..... *E21B 43/11852* (2013.01); *E21B 23/006* (2013.01); *E21B 43/11857* (2013.01); *E21B 23/04* (2013.01)

(58) Field of Classification Search
CPC ..... E21B 43/11852; E21B 23/006; E21B 11/857; E21B 23/04; E21B 43/00
See application file for complete search history.

(56) References Cited

U.S. PATENT DOCUMENTS 3,800,705 A 4/1974 Tamplen
4,576,233 A 3/1986 George
(Continued)

FOREIGN PATENT DOCUMENTS

EP 0092476 A2 10/1983
EP 0288239 A2 10/1988
(Continued)

OTHER PUBLICATIONS

Hunting Titan, Ball Drop Hydraulic Actuated Firing Head, Mar. 22, 2015, 2 pages, http://www.hunting-intl.com/titan/tcp-firing-heads-and-hardware/ball-drop-hydraulic-actuated-firing-head.
Hunting Titan, Wireline Hardware, Logging Instruments EBFire, TCB Systems, Gun Systems, 2015, V.9.1, 72 pgs., http://www.hunting-intl.com/media/1305595/hunting-titan-complete-v9-1.pdf.
Schlumberger, HDF Hydraulic Delay Firing Head, Jul. 3, 2013, 3 pgs., https://www.slb.com/~/media/Files/perforating/product_sheets/tubing_conveyed_perforating/firing_systems/hdf_ps.pdf.
(Continued)

*Primary Examiner* — D. Andrews
*Assistant Examiner* — Manuel C Portocarrero
(74) *Attorney, Agent, or Firm* — Moyles IP, LLC

(57) ABSTRACT

A firing head assembly is described. The firing head assembly includes a tubular housing, upper piston and lower pistons, and a compressible member arranged within a lumen of the tubular housing and positioned between the upper and lower pistons. According to an aspect, the assembly includes a safety assembly that includes a sleeve having a zigzag shaped slot therein. The safety assembly may include a key that radially extends from a surface of one of the pistons, through the zigzag shaped slot. The distance between the upper and lower pistons may be adjusted by adjusting a pressure inside the tubular housing and a second pressure outside the tubular housing. The upper and lower pistons may function to operatively adjust the arrangement of the key within the zigzag shaped slot to activate the firing head assembly to either trigger an explosive reaction or to not trigger the explosive reaction.

20 Claims, 11 Drawing Sheets

(56) References Cited

U.S. PATENT DOCUMENTS

| | | | |
|---|---|---|---|
| 4,616,701 | A | 10/1986 | Stout et al. |
| 4,817,718 | A | 4/1989 | Nelson et al. |
| 4,886,127 | A | 12/1989 | Ricles et al. |
| 5,103,912 | A | 4/1992 | Flint |
| 5,165,489 | A | 11/1992 | Langston |
| 5,301,755 | A | 4/1994 | George et al. |
| 5,400,856 | A | 3/1995 | Schmidt |
| 5,887,654 | A | 3/1999 | Edwards et al. |
| 5,971,072 | A | 10/1999 | Huber et al. |
| 6,055,213 | A | 4/2000 | Rubbo et al. |
| 6,364,017 | B1 | 4/2002 | Stout et al. |
| 7,487,833 | B2 | 2/2009 | Grigar et al. |
| 8,726,996 | B2 | 5/2014 | Busaidy et al. |
| 9,145,748 | B1 | 9/2015 | Meier et al. |
| 9,388,665 | B2 | 7/2016 | Caminari |
| 9,540,913 | B2 | 1/2017 | Moore |
| 2014/0318766 | A1 | 10/2014 | Bishop |
| 2015/0041135 | A1 | 2/2015 | Coffey et al. |

FOREIGN PATENT DOCUMENTS

| | | | |
|---|---|---|---|
| EP | 0586223 | A2 | 3/1994 |
| EP | 0647765 | A2 | 4/1995 |
| GB | 2290128 | A | 12/1995 |

OTHER PUBLICATIONS

Petrowiki, Perforating Equipment,Nov. 21, 2014, 8 pgs., https://petrowiki.org/Perforating_equipment.

Innovation, Science and Economic Development Canada, Canadian Intellectual Property Office, Canadian Office Action of App. No. CA 3,024,982, dated Nov. 20, 2019, which is in the same family as U.S. Appl. No. 16/190,465, 4 pgs.

International Search Report and Written Opinion of International App. No. PCT/EP2018/082373, dated Jan. 4, 2019, which is in the same family as U.S. Appl. No. 16/190,465, 16 pgs.

HYDRAULIC UNDERBALANCE INITIATED SAFETY FIRING HEAD, WELL COMPLETION APPARATUS INCORPORATING SAME, AND METHOD OF USE

CROSS-REFERENCE TO RELATED APPLICATIONS

This application claims the benefit of U.S. Provisional Patent Application No. 62/591,818 filed Nov. 29, 2017, which is incorporated herein by reference in its entirety.

FIELD

This disclosure generally relates to a firing head assembly. More specifically, a firing head assembly having a safety assembly, for use in conjunction with a perforating gun is described.

BACKGROUND

In the extraction of hydrocarbons, such as fossil fuels (e.g., oil) and natural gas, from underground wellbores extending deeply below the surface, complex machinery and explosive devices are utilized. It is common practice to facilitate the flow of production fluid by perforating a fluid bearing subterranean formation using a perforating gun, which is lowered into the wellbore to the depth of the formation and then detonated to form perforations in the formation surrounding the perforating gun. A firing head assembly is coupled to the gun and initiated/activated to fire the gun. While the firing head assembly may be coupled to the perforating gun before the gun is lowered into the wellbore, it is often preferred for safety and other reasons, to allow initiation of the firing head only after the gun is positioned in the wellbore. An initiator is designed to fire the explosive train in the perforating gun after the initiator sees/receives an appropriate command from the surface.

It is very important that the firing head used to initiate explosives in a perforating gun be reliable and safe in operation. There have been numerous accidents resulting in severe injury or death where an explosive well tool, such as a perforating gun, fires prematurely at the surface of a wellbore while personnel are rigging the tool in preparation for running it into the wellbore.

There may be countless reasons for an operator or personnel to decide not to fire a perforating gun that has been run into the wellbore. Such reasons may include problems with running the perforating gun into the wellbore (i.e., running in hole), problems with other completion equipment or problems with the perforating gun assembly or its related components. In addition, one potential risk is that after the firing procedure is performed, there may be no positive indication that the perforating gun actually fired, which may mean that there are live explosives/shaped charges returning to the surface of the wellbore. This may endanger all personnel and equipment present at the surface when the perforating guns are retrieved to the surface.

In view of continually increasing safety requirements and the problems described hereinabove, there is a need for a firing head assembly that facilitates safe initiation of shaped charges in a perforating gun. There is also a need for a firing head assembly for use in a perforating gun that reduces the risk of property damage and bodily harm, including death, in a firing condition. Furthermore, there is a need for a firing head assembly having a safety feature, which will not allow the perforating gun to fire unless an operator selects the option to fire the perforating gun. Additionally, there is a need for a firing head assembly that allows an operator to abort a firing operation in a manner that prevents firing of the perforating gun.

BRIEF DESCRIPTION

According to an aspect, the present embodiments may be associated with a firing head assembly. The firing head assembly includes a tubular housing having a first end, a second end, and a lumen that extends between the first and second ends. An upper piston is slidably disposed proximate to the first end of the tubular housing, and a lower piston is slidably disposed proximate to the second end of the tubular housing. Each piston at least partially extends into the lumen of the tubular housing. The firing assembly may further include a compressible member within the tubular housing. The compressible member has a first end portion that is coupled to the upper piston, and a second end portion that is coupled to the lower piston. The firing head assembly includes a safety assembly having a sleeve and a key. In an embodiment, the sleeve includes a substantially zigzag-shaped slot having a plurality of stop points. The key may radially extend from an external surface of the upper piston through the zigzag-shaped slot in such a manner that slides through the slot and engages with at least one of the plurality of stop points of the slot. The firing head assembly may further include a first securing element positioned along the second end of the tubular housing. The upper piston operatively adjusts the arrangement of the key within the zigzag-shaped slot to activate the firing head assembly.

According to an aspect, the present embodiments may also be associated with a well completion apparatus. The well completion apparatus includes a perforating gun, and a firing head assembly operably associated with the perforating gun. Similar to the firing head assembly described hereinabove, the well completion apparatus includes a tubular housing, upper and lower pistons positioned proximate to the first and second ends of the tubular housing, respectively, and slidably moveable within a lumen of the tubular housing. A compressible member is positioned within the lumen, and is adjustable between a relaxed state, a compressed state and a partially compressed state. The compressible member has a first end portion that abuts the upper piston, and a second end portion that abuts the lower piston. The pressure activated firing assembly further includes a safety assembly, which may be configured as described hereinabove.

Further embodiments of the disclosure are associated with a method of using a pressure activated firing head assembly in both a firing condition and a non-firing condition. In an embodiment, the method includes positioning a perforating gun at a desired location. The perforating gun includes a firing head assembly configured substantially as described hereinabove. The firing head assembly includes a tubular housing having a first end, a second end, an inner diameter, and a lumen extending between the first and second ends of the tubular housing. In an embodiment, the firing head assembly includes an upper piston and a lower piston. The upper piston and the tubular housing at least partially define an upper chamber of the lumen above the upper piston, while the lower piston and the tubular housing at least partially define a lower chamber of the lumen below the lower piston. The compressible member is in an intermediate chamber between the upper and lower chambers. The upper, intermediate, and lower chambers each have a respective pressure. According to an aspect, the method further includes adjusting the first pressure and the second pressure to initiate an event. The event may be one of triggering an explosive reaction in the firing condition, and canceling an explosive reaction in the non-firing condition.

BRIEF DESCRIPTION OF THE FIGURES

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1:
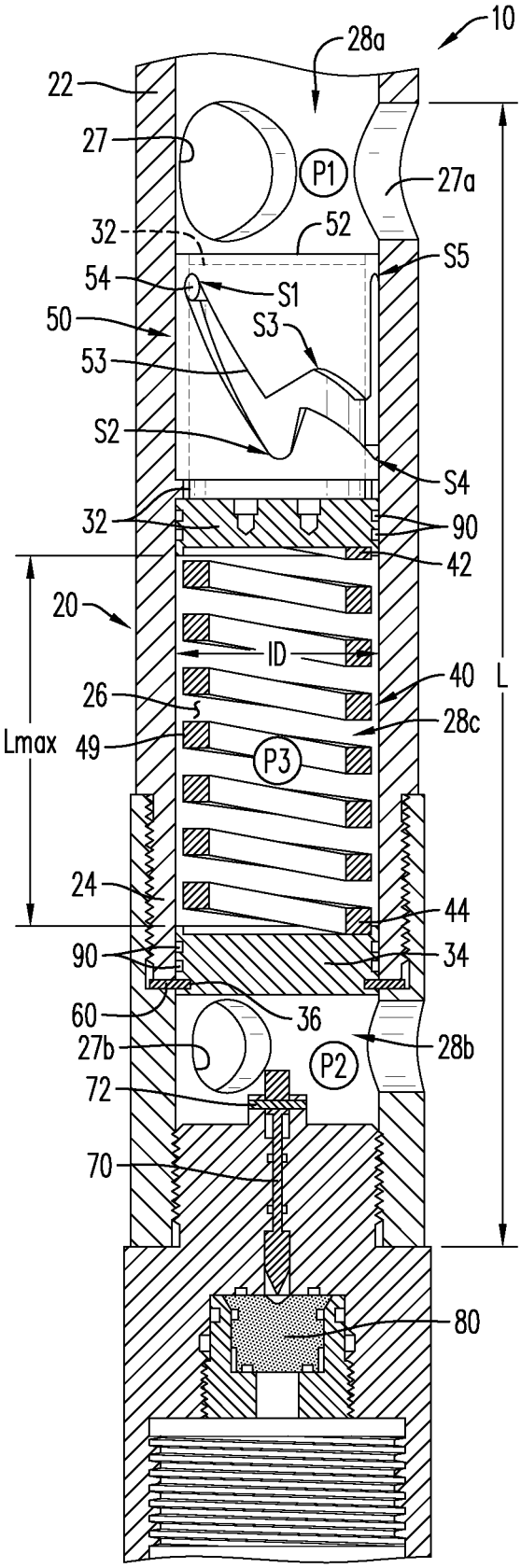
FIG. 1 is a partial cross-sectional, perspective view of a firing head assembly, illustrating a compressible member in a relaxed state and a safety assembly, according to an embodiment.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION

Reference will now be made in detail to various embodiments. Each example is provided by way of explanation, and is not meant as a limitation and does not constitute a definition of all possible embodiments.

As used herein, the term "underbalanced" refers to a procedure where before perforating a wellbore, the pressure in the wellbore is lower than the static pressure inside the adjacent formation. Once the wellbore has been perforated, fluid (e.g., oil and gas) in the formation flows into the wellbore.

For purposes of illustrating features of the embodiments, reference will be made to various figures. FIGS. 1-6 generally illustrate various embodiments of a firing head assembly. As will be discussed in connection with the individual illustrated embodiments, the firing head assembly generally includes a tubular housing/body, an upper piston and a lower piston, and a compressible member arranged between the upper and lower pistons. The firing head assembly may also include a safety assembly having a sleeve and a key. The safety assembly in combination with the compressible member helps to facilitate safe rigging up and installation of a perforating gun string into the wellbore, safe initiation of shaped charges in a perforating gun, and safe retrieval of the perforating gun from a wellbore.

Turning now to the figures, FIGS. 1-6 illustrate a perspective view of a firing head assembly 10 (with at least some components being partially cutaway). The firing head assembly 10 includes a tubular housing or tubular body 20, an upper piston 32, a lower piston 34, and a compressible member 40 arranged within the tubular housing 20.

According to an aspect, the tubular housing 20 includes a first end 22 and a second end 24. The second end 24 may be spaced apart from the first end 22 by the housing body, with a lumen (i.e., interior space) 26 extending therebetween. The lumen 26 has an inner diameter ID, which in some embodiments, is constant along a length L of the tubular housing 20.

The upper and lower pistons or driving members 32, 34 are illustrated as being spaced apart from each other. According to an aspect, the upper piston 32 is slidably disposed proximate to the first end 22 of the tubular housing 20, while the lower piston 34 is slidably disposed proximate to the second end 24 of the tubular housing 20. Each of the upper and lower pistons 32, 34 at least partially extends into the lumen 26 of the tubular housing 20, and may be longitudinally movable therein. According to an aspect, the upper piston 32 move towards and/or away from the lower piston 34. As will be discussed further below, movement of the upper piston 32 within the lumen 26 operatively adjusts the arrangement of a key 54 of a safety assembly 50 within the zigzag-shaped slot 53 in order to activate the firing head assembly 10. The lower piston 34 is configured to move away from the upper piston 32 when the firing head assembly is activated, as will be described in further detail hereinbelow. According to an aspect, at least one of the upper piston 32 and the lower piston 34 is compressively fitted and partially arranged within the lumen 26 of the tubular body 20. In this configuration, movement of the pistons 32, 34 is facilitated by the application or removal of a force, i.e. a change in the wellbore pressure, onto the pistons 32, 34, thereby causing them to slide within the lumen 26.

A compressible member 40 is illustrated in FIGS. 1-6 as being disposed within the lumen 26 of the tubular housing 20 between the upper piston 32 and the lower piston 34. The compressible member 40 may be sized to fit within the lumen 26 of the tubular housing 20. According to an aspect, the compressible member 40 is resilient and moveable/adjustable within the lumen 26. The compressible member 40 may include a first end portion/region 42 and a second end portion/region 44. The first end portion 42 abuts (i.e., is in a contacting relationship with) the upper piston 32 and the second end portion 44 abuts the lower piston 34. According to an aspect, the first end portion 42 of the compressible member 40 may be coupled to the upper piston 32, and the second end portion 44 may be coupled to the lower piston 34. In this configuration, when either the upper piston 32 or lower piston 34 moves, the compressible member 40 also moves.

Figure 4:
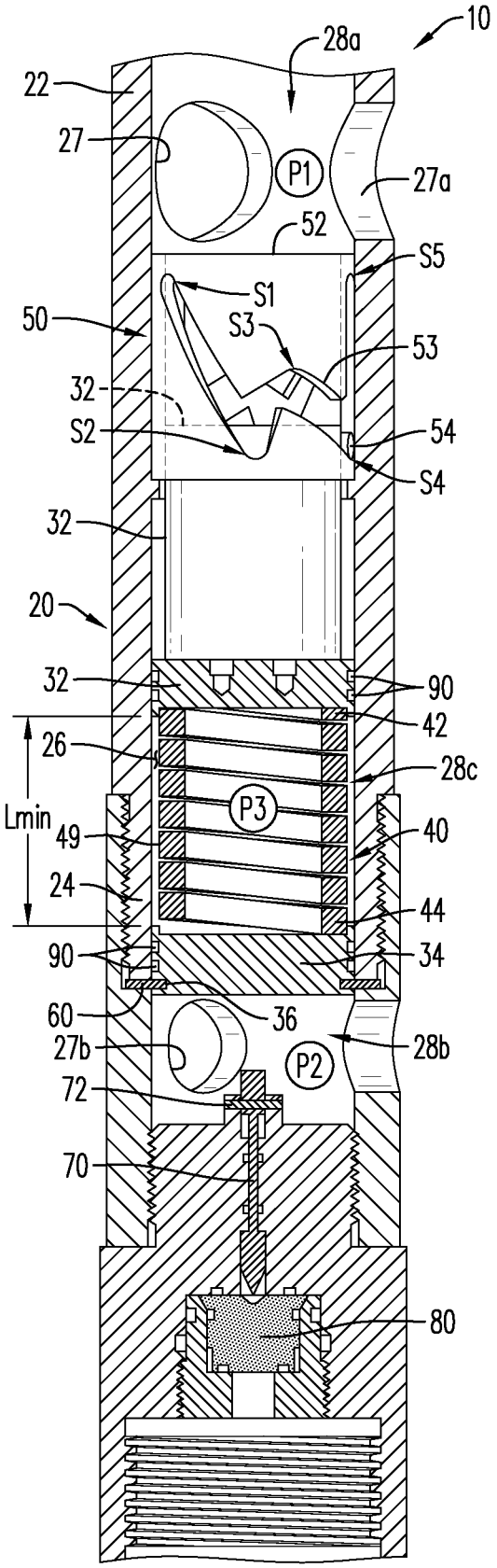
FIG. 4 is a partial cross-sectional, perspective view of the firing head assembly of FIG. 1, illustrating the compressible member in another fully compressed state.
Figure 5:
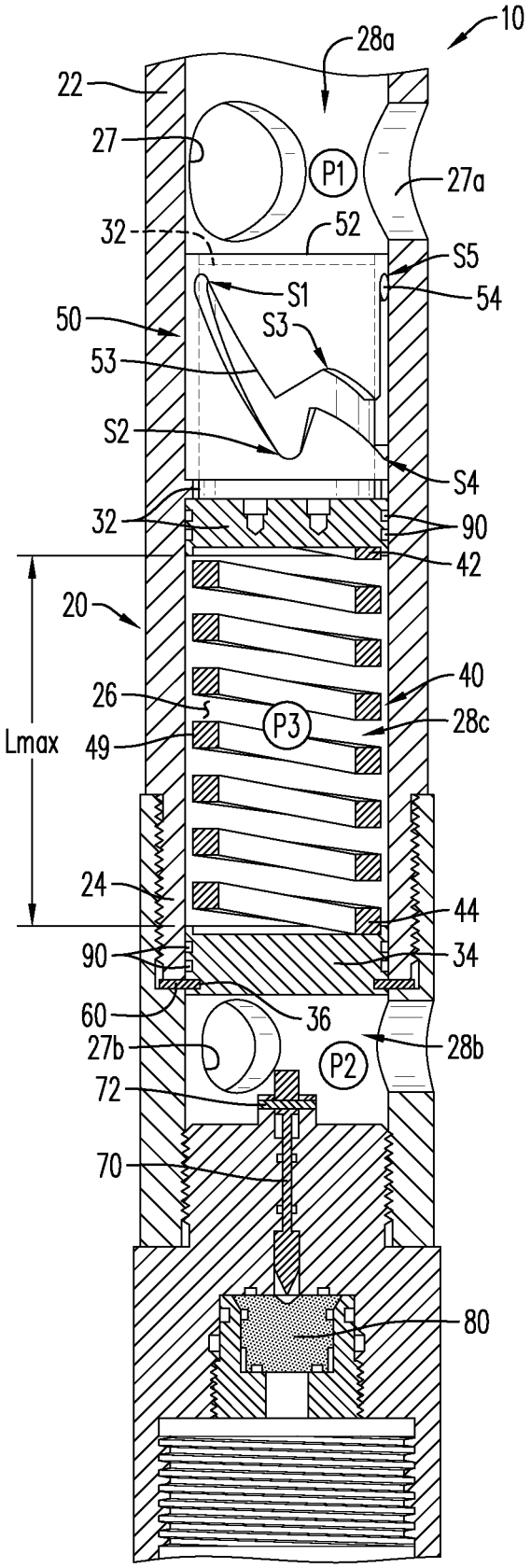
FIG. 5 is a partial cross-sectional, perspective view of the firing head assembly of FIG. 1, illustrating the compressible member in another relaxed state.
Figure 6:
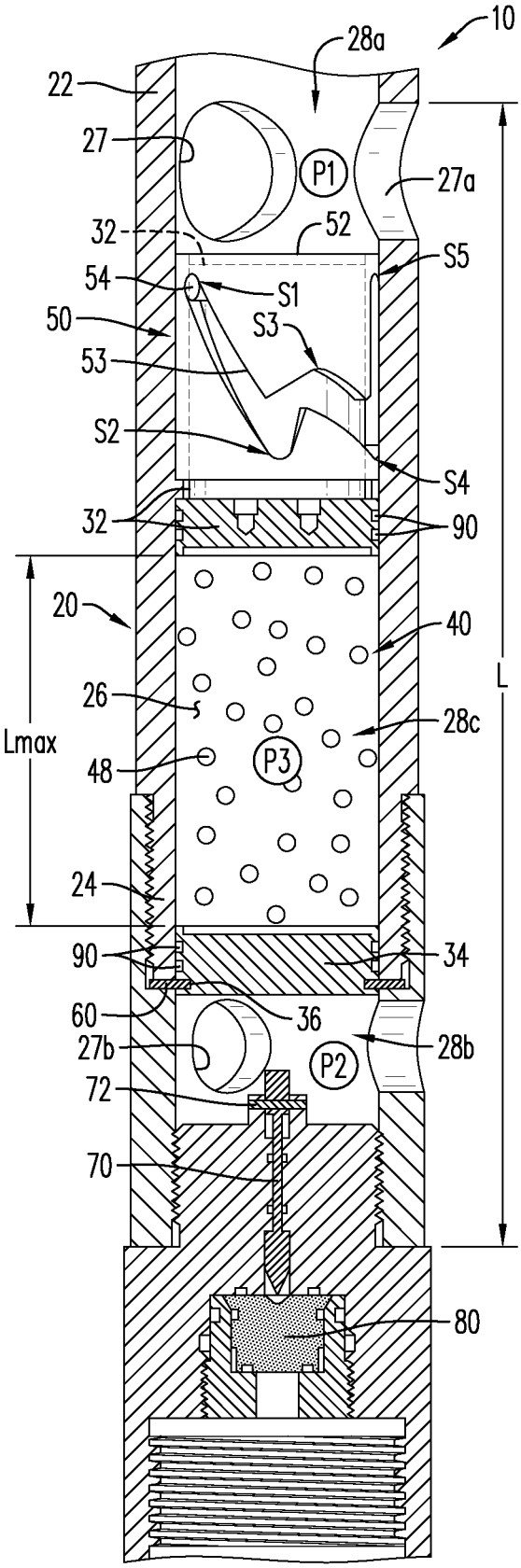
FIG. 6 is a partial cross-sectional, perspective view of a firing head assembly, illustrating a compressible gas, according to an aspect.

While FIGS. 1-5 illustrate the compressible member 40 as a spring/coil 49, it is contemplated that the compressible member 40 may be a pressurized gas 48 (FIG. 6) that is disposed within the lumen 26 and isolated between the upper piston 32 and the lower piston 34, as illustrated in FIG. 6. When the upper piston 32 moves closer towards the lower piston 34, the particles of the pressurized gas 48 move closer together and are compressed (i.e., the particles are positioned closer together), increasing the pressure within the lumen between the upper and lower pistons 32, 34.

Movement of the upper and lower pistons 32, 34 adjust the compressible member 40 between a compressed state, in which the compressible member 40 has a minimum length $L_{min}$ (FIGS. 2 and 4), and a relaxed state, in which the compressible member 40 has a maximum length $L_{max}$ (FIGS. 1, 5 and 6). As the compressible member 40 moves between the minimum length $L_{min}$ and the maximum length $L_{max}$, it relaxes or compresses to a plurality of intermediate lengths $L_{int}$ (FIG. 3) between the maximum length $L_{max}$ and the minimum length $L_{min}$. Each of the maximum length $L_{max}$, the minimum length $L_{min}$, and the intermediate lengths $L_{int}$ may correspond to a position of the key 54 when arranged in the zigzag-shaped slot 53 of the safety assembly 50, as explained below.

According to an aspect, the lumen 26 includes an upper chamber 28*a* having a first pressure P1 and a lower chamber 28*b* having a second pressure P2. The upper chamber 28*a* is disposed above the upper piston 32, and is defined by the upper piston 32 and the tubular housing 20. The lower chamber 28*b* is disposed below the lower piston 34, and is defined by the lower piston 34 and the tubular housing 20. The lumen further includes an intermediate chamber 28*c* having a third pressure P3. The intermediate chamber 28*c* houses the compressible member 40, and is disposed between the upper and lower chambers 28*a*, 28*b*. According to an aspect, the third pressure P3 is either atmospheric pressure or predetermined pressure supplied by the pressurized gas 48 (FIG. 6).

One or more ports 27 may be disposed in the housing 20 (i.e., the housing 20 may include one or more ports 27). When the firing head assembly 10 is positioned in a wellbore, the ports 27, when positioned above the upper piston 32 and below the lower piston 34, facilitate communication of a wellbore fluid with at least one of the upper chamber 28*a* and the lower chamber 28*b*. The wellbore fluid has a wellbore pressure, and the ports 27 may communicate the wellbore pressure to the lumen 26 (i.e., such that the pressure of the fluid in the wellbore would be the same as the pressure in the lumen 26). According to an aspect, the lower chamber 28*b* includes a port/opening 27*b* in the tubular housing 20 that fluidly connects the wellbore to the lower chamber 28*b*, so that the second pressure P2 is the same as the wellbore pressure. In this configuration, the second pressure P2 of the lower chamber 28*b* may be different from the first pressure P1 of the upper chamber 28*a*. According to an aspect, the upper and lower chambers 28*a*, 28*b* each comprise a respective port 27*a*, 27*b* that fluidly connects the wellbore to the upper and lower chambers 28*a*, 28*b*. This arrangement facilitates the first and second pressures P1, P2 being the same as the wellbore pressure, because the respective ports 27*a*, 27*b* are both open to the wellbore environment.

According to an aspect, the first and second pressures P1, P2 may be adjusted by moving the firing head assembly 10 downwardly or upwardly in the wellbore, or by adding or removing some wellbore fluid from the wellbore. As would be understood by one of ordinary skill in the art, an operator of the firing head assembly 10 may adjust the pressure of the wellbore by either adding or removing a selected fluid to the wellbore. The selected fluid may include nitrogen, an industry standard, or any other fluid with a lower density than the wellbore fluid.

According to an aspect, the firing head assembly 10 includes a plurality of sealing members/pressure seals 90. The sealing members 90 may include one or more O-rings that extend around the upper piston 32 and the lower piston 34. It is contemplated that the sealing members 90 may help to secure the upper and lower pistons 32, 34 within the lumen 26. In an embodiment, at least one of the sealing members 90 is positioned between the upper piston 32 and the lumen 26 of the tubular housing 20, while at least one other of the sealing members 90 is positioned between the lower piston 34 and the lumen 26 of the tubular housing 20. The sealing members 90 help isolate the compressible member 40, and the third pressure P3 in the intermediate chamber 28*c*, from the wellbore fluid and/or the wellbore pressure as well as from the first and second pressures P1, P2. The sealing members 90 additionally isolate the third pressure P3 of the intermediate chamber 28*c* from the first pressure P1 of the upper chamber 28*a*, and the third pressure P3 of the intermediate chamber 28*c* from the second pressure P2 of the lower chamber 28*b*. In an embodiment, since the first and second pressures P1, P2 may be different from the third pressure P3 in the intermediate chamber 28*c*, as described hereinabove, the sealing members 90 maintain the individual pressures P1, P2, P3, as well as maintain a pressure differential between the third pressure P3 of the intermediate chamber 28*c*, and the first and second pressures P1, P2 of the upper and lower chambers 28*a*, 28*b*, respectively.

In an embodiment, the firing head assembly 10 includes a safety assembly 50. The safety assembly 50 facilitates use of the firing head assembly 10 in an underbalanced condition in such a manner that an associated perforating gun (FIG. 9) can be safely rigged up, conveyed, and fired, and where necessary, retrieved from a wellbore.

Figure 7:
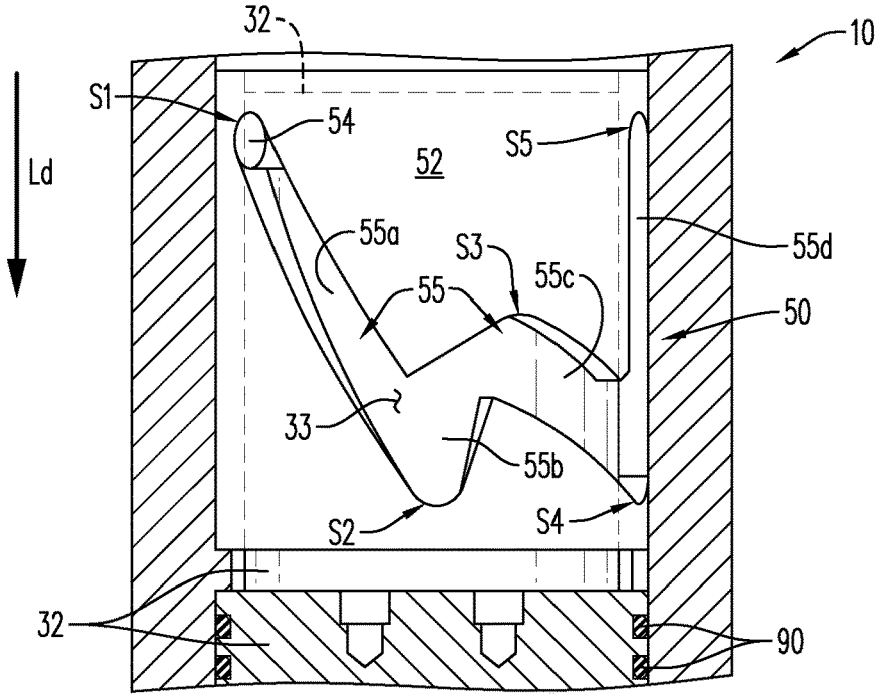
FIG. 7 is a perspective view of the safety assembly of FIGS. 1 to 6.

FIG. 7 illustrates the safety assembly 50 in detail. The safety assembly 50 includes a sleeve 52. The sleeve 52 is fixed to the tubular housing 20 with at least a portion of the upper piston 32 slidably arranged inside the sleeve 52, so at to facilitate movement of the upper piston 32 relative to the sleeve 52. In an embodiment, the sleeve 52 includes a substantially zigzag-shaped slot (i.e., slit, void, or opening) 53. The slot 53 may be characterized as having a plurality of segments or openings 55 that are contiguous or interconnected with one another (i.e., such that the slot may be characterized as having a plurality of interconnected slot segments). In the illustrated embodiment, the slot 53 includes four openings 55*a*, 55*b*, 55*c*, 55*d*. Openings 55*a*, 55*b*, 55*c* are obliquely oriented (i.e., slanted) with respect to a lengthwise direction Ld extending along the length L of the firing head assembly 10, while opening 55*d* extends substantially along (or substantially parallel to) the lengthwise direction Ld extending along the length L of the firing head assembly 10, although other configurations are contemplated hereby. The four openings 55*a*, 55*b*, 55*c*, 55*d* may be arranged so that they form two substantially V-shaped openings that are connected to each other at their innermost ends (see, for instance, the intermediate stop point S3 illustrated in FIG. 7 and described in further detail hereinbelow). The two substantially V-shaped openings, when connected at their innermost ends, may form a substantially W-shaped opening (i.e., such that slot 53 is substantially W-shaped). According to an aspect, the face of the two V-shaped openings are unsymmetrical along a midpoint of the W-shaped slot 53. In other words, at least one of the openings 55*a*, 55*b*, 55*c*, 55*d* may have a different length from an adjacent opening. Each opening 55*a*, 55*b*, 55*c*, 55*d* may also be unequally spaced apart from each other.

When two of more of the openings 55 are joined together in an alternating angled configuration, the openings 55 form the zigzag shaped slot 53. The openings 55 terminate at stop points (i.e., abutments, or notches) S. While FIGS. 1-7 illustrate 5 stop points, it is to be understood that the number of stop points S may be adjusted based on the needs of the application. For instance, the number of stops may be 3, 4, 5, 6, 7 or more. The stop points S may be formed at each corner (i.e., junction, or connection) between the individual openings 55 of the slot 53, and at free ends or terminals of the openings 55 of the zigzag shaped slot 53. The junctions of the zigzag shaped slot 53 may be where two of the openings 55 intersect. As seen in FIG. 7, for example, when one opening 55*a* is joined to another opening 55*b*, they may include three stop points, one stop point S2 where the openings 55*a*, 55*b* join each other, and two stop points S1, S3 at each of their other ends (free ends).

According to an aspect, the safety assembly 50 includes a key 54. The key 54 radially extends from (i.e., extends outwardly from) an external surface 33 of the upper piston 32. As best seen in FIG. 7, the key 54 at least partially extends through the zigzag shaped slot 53. This configuration allows the key to slide through the different openings 55 of the zigzag shaped slot 53. In other words, the zigzag shaped slot 53 serves a path or a positional guide that helps guide/move the key 54 to a desired location, which may be one of the stop points S. An increase or decrease of the first pressure P1 in the upper chamber 28*a*, adjusts the position or location of the key 54 in the zigzag shaped slot 53 (as seen, for instance, in each of FIGS. 1-7). Adjustment of the key 54 in the zigzag shaped slot 53 correlates to the different lengths $L_{max}$, $L_{int}$, and $L_{min}$ of the compressible member 40. As seen for instance in FIG. 2, an increase of the first pressure P1 moves the upper piston 32 downwards, which adjusts the compressible member 40 to a compressed state and moves the key 54 generally downward in the zigzag-shaped slot 53. Alternatively, when the first pressure P1 is decreased, the upper piston 32 moves in an upward direction, which adjusts the compressible member 40 to a relaxed (as seen, for instance, in FIG. 5) or partially compressed state (as seen, for instance, in FIGS. 3*a* and 3*b*) and moves the key 54 generally upwardly in the zigzag shaped slot 53. Each stop point S helps restrict or prevent movement of the key 54 when the key 54 is seated in that particular stop point S, unless the first pressure P1 (i.e., the pressure in the upper chamber 28*a*) is adjusted.

As illustrated in FIGS. 1-6, for example, the firing head assembly 10 includes a firing pin 70 positioned below the lower piston 34 in a spaced apart configuration, and a percussion initiator 80 positioned below the firing pin 70 also in a spaced apart configuration. The safety assembly 50, in conjunction with the pistons 32, 34 and the compressible member 40, helps facilitate selective activation of the firing head assembly 10, by adjusting the distance (such as, by reducing the distance) between the firing pin 70 and the initiator 80. According to an aspect, the distance is adjusted so that the firing pin 70 is brought into contact with the initiator 80, thereby triggering/activating an explosive reaction. The explosive reaction may start a sequence of events that causes shaped charges 122 loaded in a perforation gun 120 (see, for example, FIG. 9) to detonate.

Figure 8A:
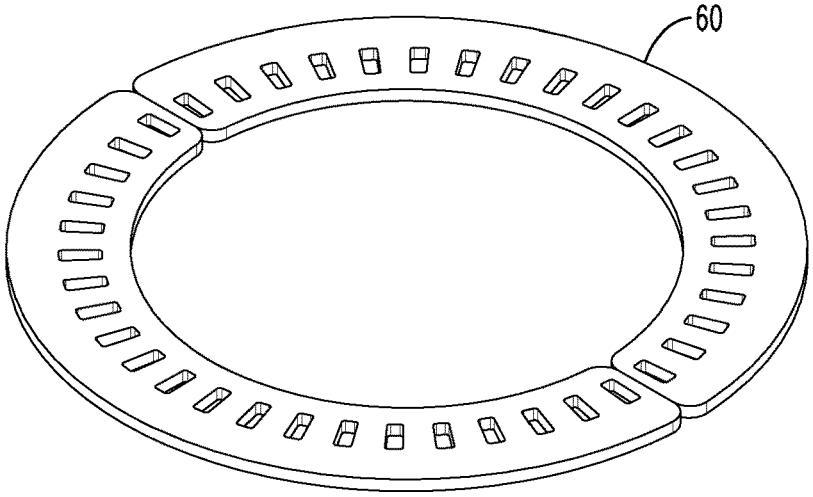
FIG. 8A is a perspective view of a shear ring for use as a securing element with a firing head assembly, according to an embodiment.
Figure 8B:
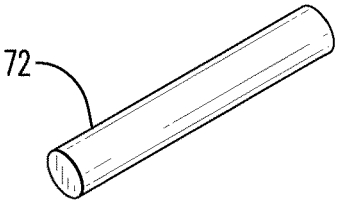
FIG. 8B is a perspective view of a shear pin for use as a securing element with a firing head assembly, according to an embodiment.

Securing elements, such as those depicted in FIGS. 8A-8B, may be utilized to retain the lower piston 34 and the firing pin 70 in their spaced-apart configurations. The securing elements have a maximum strength (i.e., the largest force they can withstand before breaking). According to an aspect, the securing elements include a shear pin (FIG. 8B) or a shear screw (not shown). As illustrated in FIG. 8A, the securing elements may be a shear ring. The shear ring may be configured as a relatively thin plate of material composed of a relatively soft, yet rigid material. The shear ring includes a central opening that allows the shear ring to be positioned around a periphery of the lower piston 34 or the firing pin 70. As seen for instance in FIG. 8A, the shear ring includes a plurality of gaps/slits or weakened areas formed in its body. These gaps allow the shear ring to break at a specified pressure differential or to withstand a selected force. The selected securing element, such as the described shear ring, may be selected based on wellbore conditions and its maximum strength. In an embodiment, each securing element has a designated strength that allows it to break predictably at a specified value. For example, a selected securing element may be configured to withstand a force from between about 500 psi to about 35,000 psi, for example, from between about 500 psi to about 25,000 psi, before breaking at its specified value.

According to an aspect, the firing head assembly 10 includes a first securing element 60 positioned along the second end 24 of the tubular housing 20 to maintain the lower piston 34, and a second securing element 72 to maintain the firing pin 70 in the spaced apart configuration from the percussion initiator 80. The first securing element 60 at least temporarily retains the lower piston 34 in a spaced apart configuration from the firing pin 70. The first securing element 60 retains the lower piston 34 in this configuration, so long as its maximum strength is not exceeded. As illustrated in FIGS. 1-3*a*, and 4-6, when the first securing element 60 is configured as a shear ring, it may be secured in depressions 36 extending around the outer surface of the lower piston 34. According to an aspect, a decrease of the first and second pressures P1, P2 until they are less than the third pressure P3 results in a pressure differential, and generates a force across the first securing element 60. When this force across the first securing element 60 is less than the compressive force generated by the compressible member 40 or the maximum strength of the first securing element 60, the first securing element 60 breaks and releases the lower piston 34 from its position. In other words, the pressure differential is operative for breaking the first securing element 60 to release the lower piston 34. The lower piston 34 moves downwardly and contacts the firing pin 70 to strike and break/shear the second securing element 72. Once the second securing element 72 is broken, the firing pin 70 is released from its position and moves downwardly towards the percussion initiator 80. The firing pin 70 applies a downward force to the percussion initiator 80, which triggers the explosive reaction.

Figure 9:
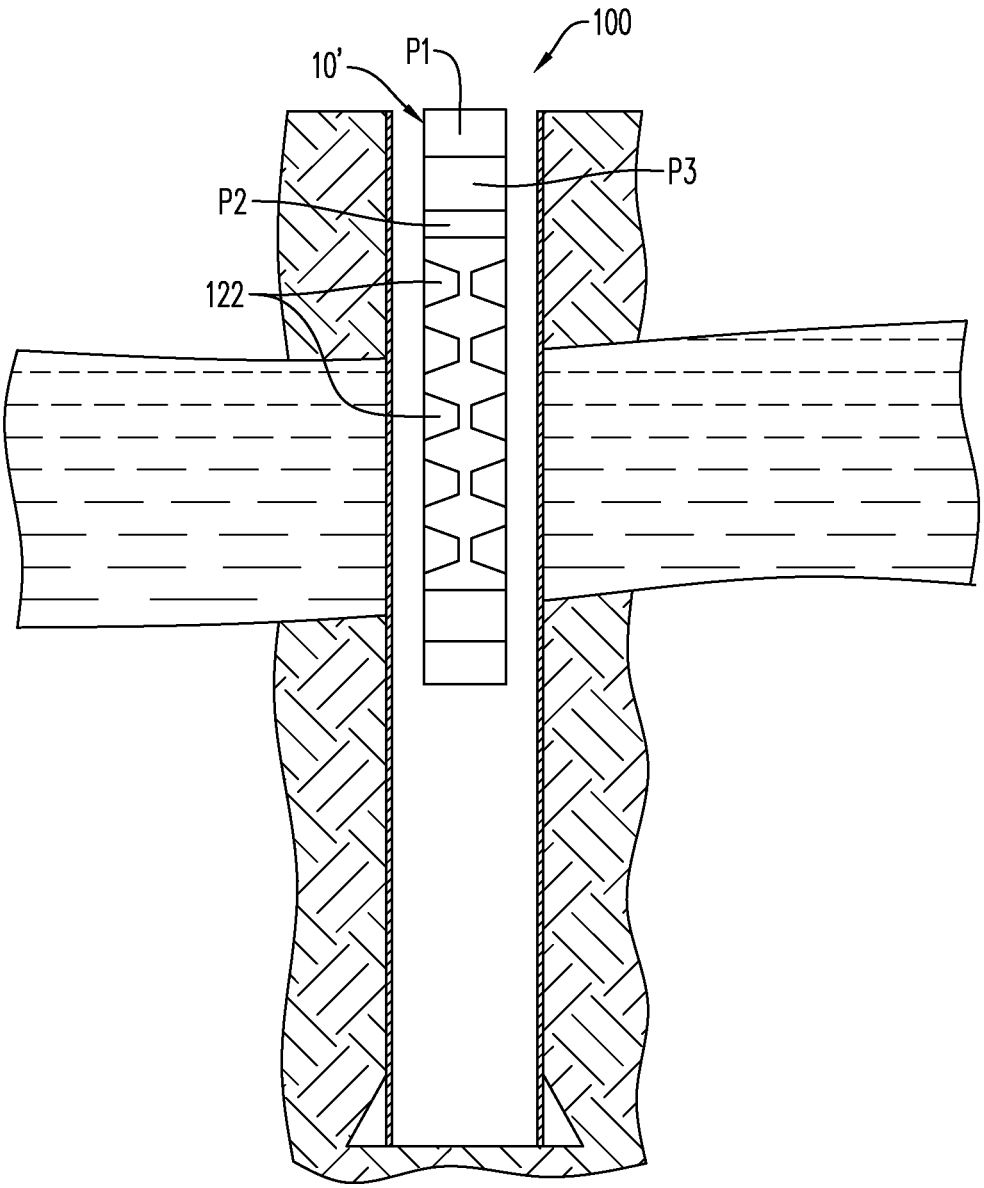
FIG. 9 is a cross-sectional view of a well completion apparatus including a pressure activated firing head assembly, according to an embodiment.

According to an aspect and as shown in FIG. 9, embodiments of the disclosure are further directed to a well completion apparatus 100. The well completion apparatus 100 includes a perforating gun 120 having a plurality of shaped charges 122. The perforating gun 120 may be an exposed perforation gun system or a carrier-type perforating assembly enclosed by a pipe. If the perforating gun 120 is an exposed system, the shaped charges 122 are individually encapsulated or sealed to prevent direct exposure to fluids and/or pressure from the wellbore environment. In any event, when the perforating gun 120 is fired and the shaped charges 122 detonate, an explosive jet is formed, which perforates the surrounding formation in the wellbore to extract fluid (such as oil, gas, and the like) therefrom.

The perforating gun 120 is operably associated with a firing head assembly 10'. In this embodiment, the firing head assembly 10' is substantially similar to the firing head assembly 10 illustrated in FIGS. 1-8B and described hereinabove. Thus, for purposes of convenience and not limitation, the various features, attributes, properties, and functionality of the firing head assembly 10' discussed in connection with FIGS. 1-8B are not repeated here.

Figure 2:
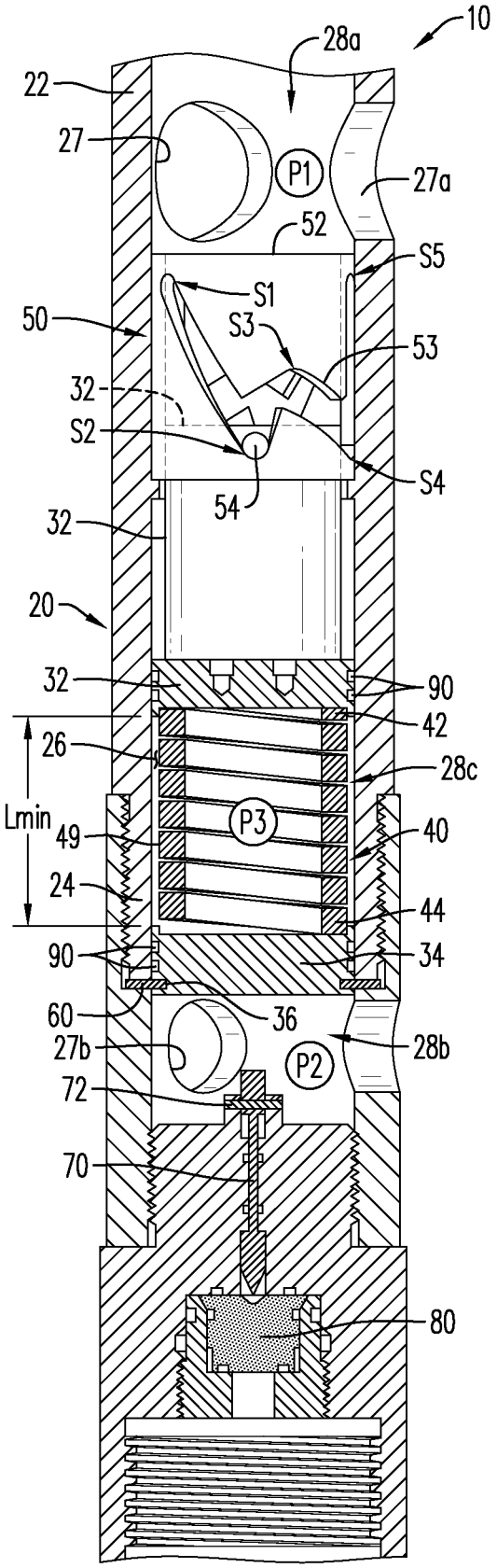
FIG. 2 is a partial cross-sectional, perspective view of the firing head assembly of FIG. 1, illustrating the compressible member in a charged state.

As described hereinabove, the firing head assembly 10' includes a safety assembly 50 having a sleeve 52 and a key 54. The sleeve 52 includes a substantially zigzag-shaped slot 53, having a plurality of stop points S, within with the key 54 slides to adjust the compressible member 40 between relaxed, compressed, and partially-compressed states. According to an aspect, the stop points S include two or more distal stop points S1, S5 spaced at a substantial distance from the compressible member 40. When the key 54 is oriented at the distal stop points S1, S5, as illustrated in FIGS. 1, 5 and 6, the compressible member 40 is relaxed, and the perforating gun 120 can be safely retrieved from the wellbore. The stop points further include two proximal stop points S2, S4 spaced at a relatively shorter distance from the compressible member 40. When the key 54 is oriented at the proximal stop points S2, S4, as illustrated in FIGS. 2 and 4, the compressible member 40 is compressed or in a charged state. An intermediate stop point S3 is longitudinally and radially positioned between the distal stop points S1, S5 and the proximal stop points S2, S4. When the key 54 is oriented at the intermediate stop point S3, the compressible member 40 is in a partially-compressed state, and the completion apparatus 100 cannot be safely retrieved from the wellbore. To safely retrieve the completion apparatus 100 from the wellbore, the pressures P1, P2 must be increased to move the key 54 to stop point S4. The pressure of the wellbore can then be equalized, and the completion apparatus 100 can be safely retrieved from the wellbore. Alternatively, the operator of the well completion apparatus 100 may decrease the wellbore pressure until the first and second pressures P1, P2 are less than a compressive force of the compressible member 40. When the compressive force and the pressure differential between P1, P2 and P3 are greater than the maximum strength of the first securing element 60 that holds the lower piston 34 in place, the compressive force breaks the first securing element 60 to release the lower piston from its position. The lower piston 34 thereafter strikes the firing pin 70 with a force that breaks the second securing element 72 holding the firing pin 70 in place, so that the firing pin 70 strikes the percussion initiator 80 and triggers the explosive reaction. The shaped charges 122 will then detonate and create perforations in the formation.

Embodiments of the present disclosure further related to a method 200 of using a firing head assembly in both a firing condition 222 and a non-firing condition 224. The firing head assembly is operably associated with a perforating gun, both of which are components of a well completion apparatus. In this embodiment, the perforating gun and firing head assembly are substantially similar to the perforating gun and firing head assembly illustrated in FIGS. 1-7 and 9, and described hereinabove. Thus, for purposes of convenience and not limitation, the various features, attributes, properties, and functionality of the perforating gun and firing head assembly discussed in connection with FIGS. 1-7 and 9 are not repeated here.

According to an aspect, the method 200 includes positioning 210 a well completion apparatus, including the perforating gun and the firing head assembly in a wellbore. The first pressure and second pressures are adjusted 220 to initiate an event. According to an aspect, the adjusting step 220 includes adding 221 a fluid (i.e., a liquid or gas) to the wellbore or increasing the wellbore pressure by means of a compressed gas, or removing 223 a fluid from the wellbore or decreasing the pressure of the previously injected a compressed gas. According to an aspect, the step of adding 221 the fluid to the wellbore increases the wellbore pressure, which in turn increases the first and second pressures and charges the compressible member (such as, a spring or a compressed gas, as described hereinabove) to generate a compressive force within the intermediate chamber. Alternatively, the step of removing 223 the fluid from the wellbore decreases the wellbore pressure, which decreases the first and second pressures and at least partially reduces the compressive force of the compressible member. In an embodiment, the adjusting 220 step may include moving the perforating gun downwardly 225 or upwardly 227 in the wellbore. When the perforating gun is moved downwardly 225 in the wellbore, the first and second pressures are increased, thereby charging the compressible member so that it generates the compressive force, while moving the perforating gun upwardly 227 decreases the first and second pressures and reduces any compressive force previously-generated by the compressible member.

The event initiated by the step of adjusting 220 the first pressure and the second pressure includes one of triggering an explosive reaction in the firing condition 222, and canceling an explosive reaction in the non-firing condition 224. In both the firing and non-firing conditions 222, 224, adjustment of the first pressure changes the length of the compressible member and adjusts the arrangement of the key in the zigzag shaped slot. According to an aspect, the length of the compressible member changes as it is compressed, partially-compressed or relaxed. Additionally, when the key is arranged at one of the stop points of the zigzag shaped slot, the length of the compressible member is at least temporarily fixed until the first pressure is adjusted.

Figure 3A:
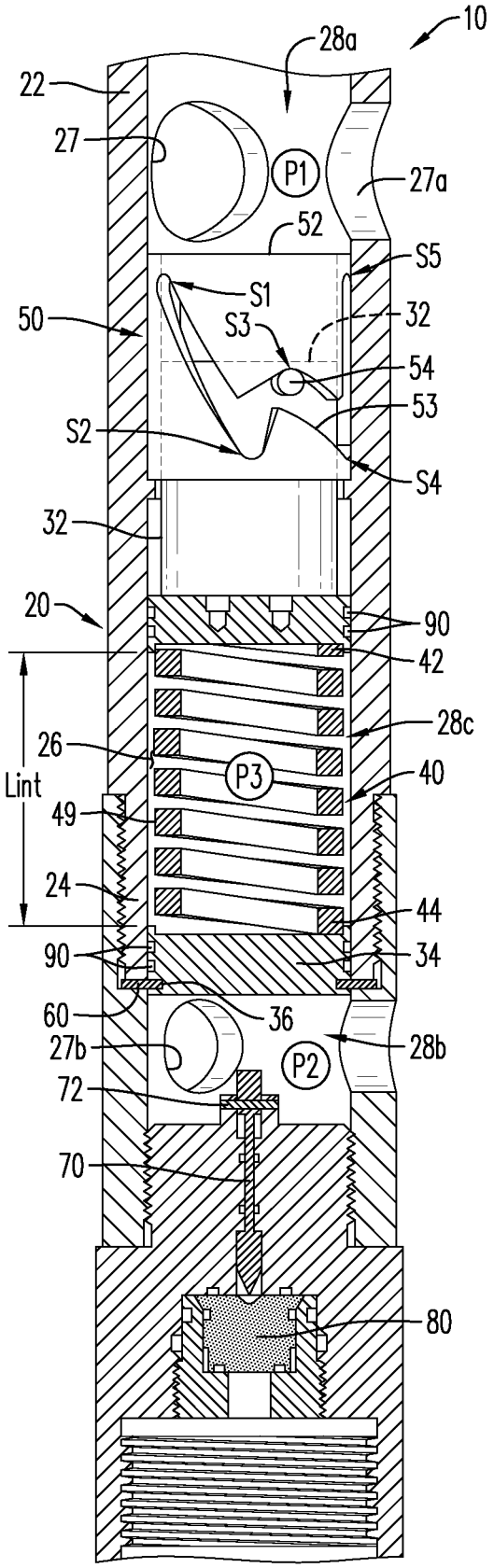
FIG. 3A is a partial cross-sectional, perspective view of the firing head assembly of FIG. 1, illustrating the compressible member in a partially compressed state and securing elements in place.
Figure 3B:
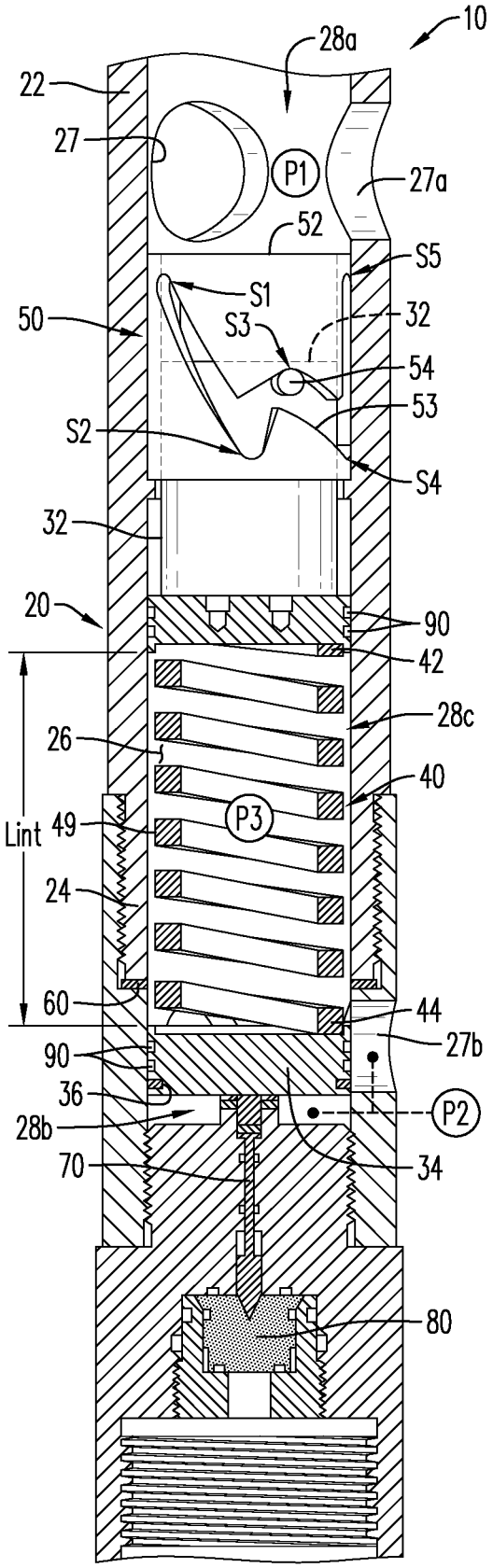
FIG. 3B is a partial cross-sectional, perspective view of the firing head assembly of FIG. 3A, illustrating the securing elements in a broken configuration, according to an embodiment.
Figure 10A:
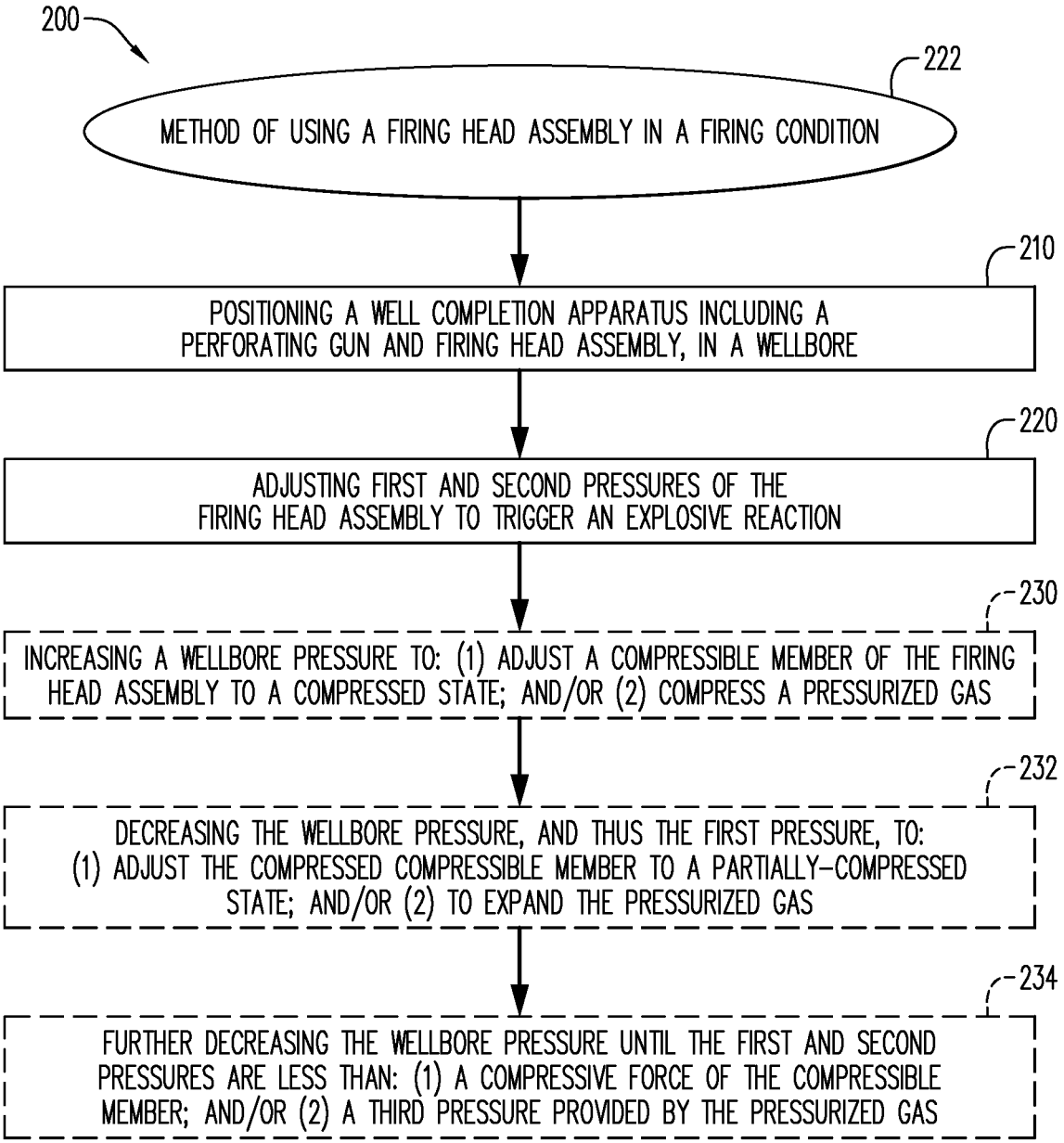
FIG. 10A is a chart illustrating a method of using a firing head assembly in a firing condition, according to an aspect.

FIG. 10A illustrates the method 200 of using the firing head assembly in the firing condition 222. In an embodiment, in the firing condition 222, the key may be initially arranged at a first distal stop point. As illustrated in FIG. 1, when the key is positioned at a distal stop point, the compressible member is at a maximum length, and is in a relaxed and uncharged state. The adjusting 220 includes increasing 230 the wellbore pressure to adjust the compressible member to a compressed state, by moving the key generally downward in the zigzag shaped slot from the distal stop point to a proximal stop point. When the key is at the proximal stop point (FIG. 2), the compressible member is at its minimum length and is compressed so that it generates a compressive force. The wellbore pressure is then decreased 232 to adjust the compressible member to a partially compressed state (FIG. 3*a*), and to move the key generally upwardly in the zigzag shaped slot to an intermediate position between the proximal and distal stop points. When the key is arranged at the intermediate stop point, the compressible member is adjusted to one of its intermediate lengths $L_{int}$. As illustrated in FIG. 7, the intermediate position is spaced apart from both the proximal and distal stop points in a horizontal direction, and is generally disposed between them in a longitudinal direction. The wellbore pressure is further decreased 234 until the first and second pressures are less than the compressive force of the compressible member. The compressive force is exerted onto the first securing element, and when the compressive force is greater than the maximum strength of the first securing element, the first securing element breaks. When the first securing element breaks, the lower piston is released so that it is no longer retained at a set/secured position. Movement of the lower piston breaks the second securing element retaining the firing pin, so that the firing pin applies a downward force onto the percussion initiator. FIG. 3*b* illustrates the firing head assembly after both the first and second securing elements have been broken. The downward force applied by the firing pin triggers the explosive reaction (i.e., results in detonation of shaped charges provided in the perforating gun).

According to an aspect, when the compressible member includes a pressurized gas, as illustrated in FIG. 6, the step of adjusting 220 includes increasing 23 the wellbore pressure to compress the pressurized gas and to move the key generally downwardly in the zigzag shaped slot from a distal stop point to a proximal stop point. The wellbore pressure is thereafter decreased 232, which partially expands the pressurized gas and moves the key generally upward in the zigzag shaped slot to the intermediate position. When the key is disposed at the intermediate position, the operator can elect to trigger or not trigger the explosive reaction. In the firing condition, the wellbore pressure is further decreased 234 until the first and second pressures are less than the third pressure (i.e., the pressurized gas). The third pressure generates a force onto the first securing element that, when greater than the maximum strength of the first securing element, breaks the first securing element and releases the lower piston. Release of the lower piston causes the pressurized gas to expand, which moves the lower piston downwardly to break the second securing element retaining the firing pin in a spaced apart configuration from the percussion initiator. When the second securing element breaks, the firing pin is released and strikes the initiator to trigger the explosive reaction.

In circumstances when the explosive reaction is not desired, the firing head assembly may be placed in a 'safe mode', whereby the perforating gun may be safely removed without triggering the explosive event. It may be desirable to retrieve the perforating gun from the perforation location when, for instance, the exposure time of the explosive is threatened to be exceeded or problems with other aspects of the completion have arisen. According to an aspect, when the key is arranged at distal stop points, the firing head assembly is in the safe mode, which allows safe retrieval of the perforating gun from the wellbore. In this safe mode, the compressible member is in a relaxed state and the firing pin is positioned away from the initiator and the perforating gun may be safely removed from the desired location without triggering the explosive reaction.

Figure 10B:
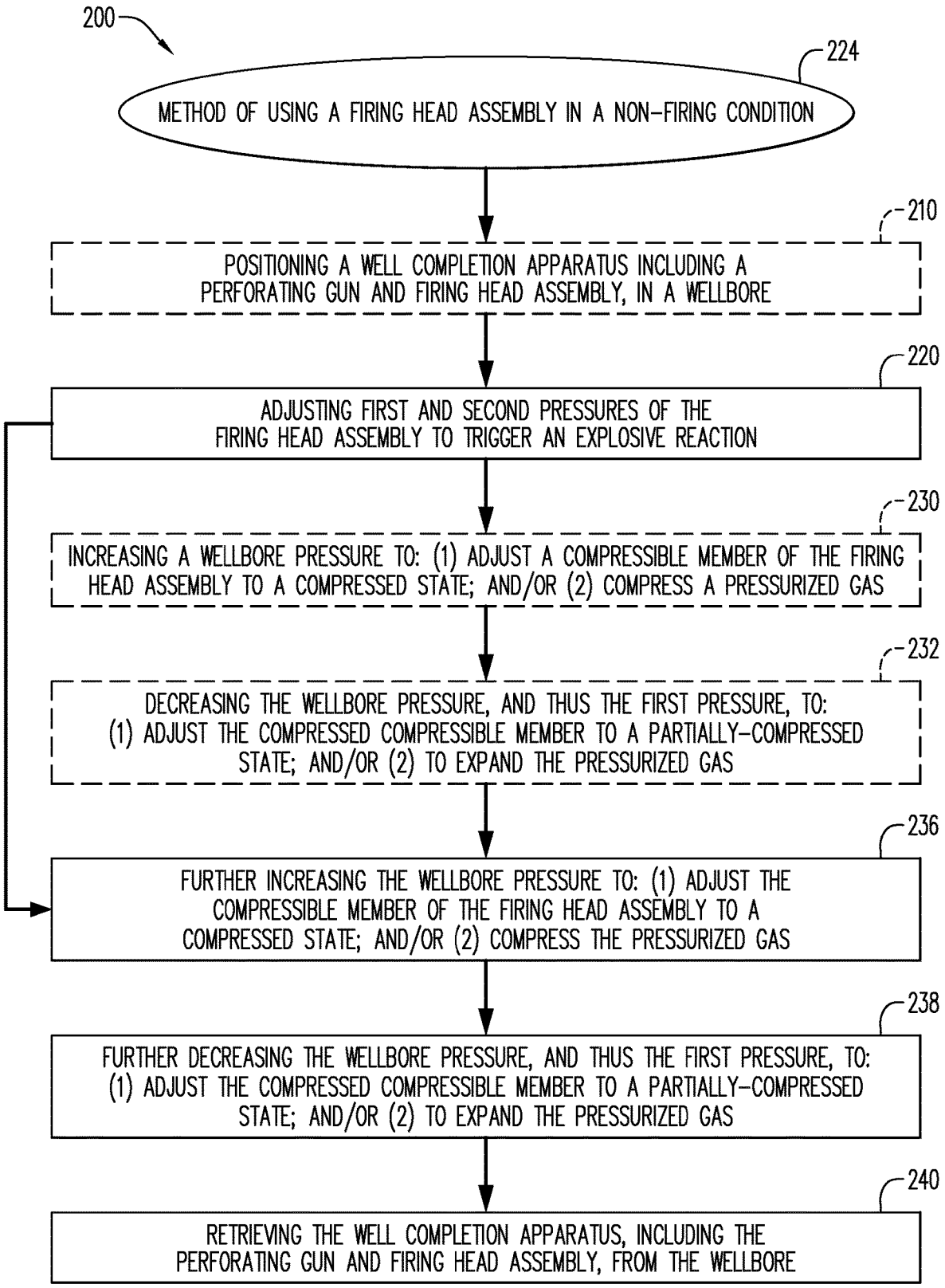
FIG. 10B is a chart illustrating a method of using a firing head assembly in a non-firing condition, according to an aspect.

FIG. 10B illustrates the method 200 of using the firing head assembly in the non-firing condition 224. The method may include the steps of increasing 230 the wellbore pressure to charge the compressible member or compress the pressurized gas, and decreasing 232 the wellbore pressure to adjust the compressible member to a partially-compressed state or expand the pressurized gas. Should the explosive event fail to occur or should the operator choose to not initiate the explosive event, the operator can safely retrieve the well completion apparatus from the wellbore. According to an aspect, in the non-firing condition 224, the key may be positioned at the intermediate stop point. In this configuration, the method further includes further increasing 236 the wellbore pressure to adjust the compressible member to a compressed state and move the key generally downwardly in the zigzag shaped slot to another proximal stop point. When positioned at this proximal stop point, the compressible member is fully compressed and is at its minimum length. The wellbore pressure is then decreased 238 to adjust the compressible member to a partially compressed state, thereby moving the key generally upwardly in the zigzag shaped slot. The well completion apparatus, including the perforating gun and firing head assembly, are retrieved 240 from the wellbore, which further adjusts the compressible member to a relaxed state.

According to an aspect, when the compressible member includes the pressurized gas, the adjustment of the wellbore pressure in the non-firing condition 224 is similar to when the compressible member is a spring. When the wellbore pressure is increased, the pressurized gas is compressed and the key moves generally downwardly in the zigzag shaped slot to another proximal stop point (as seen for instance in FIG. 4). The wellbore pressure is further decreased, to partially expand the pressurized gas and move the key generally upwardly in the zigzag shaped slot (as seen for instance in FIG. 5). The well completion apparatus can then be safely retrieved from the wellbore, without triggering the explosive event.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A firing head assembly, comprising:

a tubular housing having a first end, a second end, and a lumen extending between the first end and the second end;

an upper piston slidably disposed proximate to the first end of the tubular housing and at least partially extending into the lumen of the tubular housing;

a lower piston secured proximate the second end of the tubular housing and at least partially extending into the lumen of the tubular housing;

a compressible member comprising a first end portion and a second end portion, wherein the first end portion abuts the upper piston and the second end portion abuts the lower piston, and wherein the compressible member is within the lumen of the tubular housing;

a safety assembly comprising a sleeve and a key, the sleeve comprising a substantially zigzag-shaped slot having a plurality of stop points, and the key radially extending from an external surface of the upper piston through the zigzag-shaped slot, wherein the key is slidably arranged within the zigzag-shaped slot and engages with at least one of the plurality of stop points of the zigzag-shaped slot;

a first securing element positioned along the second end of the tubular housing and operative for retaining the lower piston in the tubular housing; and a firing pin positioned below the lower piston and retained in a spaced apart configuration from the lower piston by a second securing element, such that the first securing element releases the lower piston prior to the second securing element releasing the firing pin, wherein the upper piston operatively adjusts the arrangement of the key within the zigzag-shaped slot to activate the firing head assembly.

2. The firing head assembly of claim 1, wherein the compressible member is adjustable between a maximum length, a minimum length, and a plurality of intermediate lengths therebetween, each of the maximum length, the minimum length, and the intermediate lengths corresponding to a position of the key in the zigzag-shaped slot.

3. The firing head assembly of claim 1, further comprising:

a percussion initiator positioned below the firing pin, wherein the firing pin is retained in a spaced apart configuration from the percussion initiator by the second securing element.

4. The firing head assembly of claim 3, wherein the compressible member comprises a spring or a coil.

5. The firing head assembly of claim 3, further comprising a plurality of sealing members, wherein:

at least one sealing member is positioned between the upper piston and the lumen of the tubular housing; and at least one other sealing member is positioned between the lower piston and the lumen of the tubular housing, wherein when the firing head assembly is positioned in a wellbore, the sealing members are operative for isolating the compressible member from a wellbore fluid within the wellbore, the wellbore fluid having a wellbore pressure.

6. The firing head assembly of claim 5, wherein:

the upper piston and the tubular housing at least partially define an upper chamber of the lumen disposed above the upper piston, the upper chamber having a first pressure; and the lower piston and the tubular housing at least partially define a lower chamber of the lumen disposed below the lower piston, the lower chamber having a second pressure, wherein the compressible member is in an intermediate chamber of the lumen disposed between the upper chamber and the lower chamber, the intermediate chamber having a third pressure.

7. The firing head assembly of claim 6, wherein:

the lower chamber comprises a port that fluidly connects the wellbore to the lower chamber, so that the second pressure is the same as the wellbore pressure, and the first pressure is different from the second pressure; or the upper chamber and the lower chamber each comprise a respective port that fluidly connects the wellbore to the upper chamber and the lower chamber, so that the first pressure and the second pressure are each the same as the wellbore pressure.

8. The firing head assembly of claim 7, wherein:

an increase of the first pressure moves the upper piston downwards and adjusts the compressible member to a compressed state and moves the key generally downwardly in the zigzag-shaped slot; and a subsequent decrease of the first pressure adjusts the compressible member to a partially compressed state and moves the key generally upwardly into the next position of the zigzag-shaped slot.

9. The firing head assembly of claim 8, wherein:

the compressible member is operative for generating a compressive force and applying the compressive force onto the lower piston; and the lower piston is operative for contacting the firing pin, thus shearing the second securing element and moving the firing pin downwardly towards the percussion initiator to apply a downward force to the percussion initiator and trigger an explosive reaction.

10. The firing head assembly of claim 8, wherein when the upper chamber and the lower chamber each comprise the respective port that fluidly connects the wellbore to the upper chamber and the lower chamber, the first pressure and the second pressure are adjusted by at least one of:

moving the firing head assembly downwardly or upwardly in the wellbore; and adding or removing a fluid from the wellbore, wherein a decrease of the first and second pressures until they are less than the third pressure generates a force across the first securing element, and when the force across the first securing element is less than the compressive force generated by the compressible member, the first securing element breaks and releases the lower piston, so that the lower piston moves downwardly to strike and break the second securing element, thus releasing the firing pin and allowing the firing pin to apply a downward force to the percussion initiator to trigger an explosive reaction.

11. The firing head assembly of claim 1, wherein the compressible member comprises a pressurized gas disposed between the upper piston and the lower piston, the pressurized gas being isolated within the lumen of the tubular housing.

12. A well completion apparatus comprising:

a perforating gun; and a firing head assembly operably associated with the perforating gun, the firing head assembly comprising;

a tubular housing having a first end, a second end, and a lumen extending between the first and second ends;

an upper piston disposed proximate the first end of the tubular housing, wherein the upper piston partially extends into the lumen of tubular housing and is slidably moveable within at least a portion of the lumen;

a lower piston secured proximate the second end of the tubular housing by a first securing element and at least partially extending into the lumen of the tubular housing;

a compressible member positioned within the lumen, wherein the compressible member is adjustable between a relaxed state, a compressed state and a partially compressed state, and comprises a first end portion and a second end portion, the first end portion abutting the upper piston and the second end portion abutting the lower piston;

a safety assembly comprising a sleeve and a key, the sleeve comprising a zigzag-shaped slot having a plurality of stop points, wherein each stop point is spaced apart from an adjacent stop point, and wherein the key radially extends from an external surface of the upper piston through the zigzag-shaped slot, is slidably arranged within the zigzag-shaped slot, and is moveable between each stop point to activate and deactivate the firing head assembly; and a firing pin positioned below the lower piston and retained in a spaced apart configuration from the lower piston by a second securing element.

13. The well completion apparatus of claim 12, wherein the plurality of stop points comprise:

two or more distal stop points spaced at a substantial distance from the compressible member; and two or more proximal stop points spaced at a relatively shorter distance from the compressible member, wherein each distal and proximal stop points is radially spaced apart from other distal and proximal stop points.

14. The well completion apparatus of claim 12, wherein the first securing element has a maximum strength of about 500 psi to about 35,000 psi, and the apparatus further comprises:

a percussion initiator positioned below the firing pin, wherein the first securing element is operative for restricting movement of the lower piston, the lower piston is operative for breaking the second securing element to move the firing pin downwardly towards the percussion initiator, and the firing pin is operative for applying a downward force to the percussion initiator to trigger an explosive reaction.

15. The well completion apparatus of claim 12, wherein:

the upper piston and the tubular housing at least partially define an upper chamber of the lumen disposed above the upper piston, the upper chamber having a first pressure; and the lower piston and the tubular housing at least partially define a lower chamber of the lumen disposed below the lower piston, the lower chamber having a second pressure, wherein the compressible member is disposed within an intermediate chamber positioned between the upper chamber and the lower chamber, the intermediate chamber having a third pressure.

16. The well completion apparatus of claim 15, wherein the first pressure and the second pressure are adjusted by at least one of:

moving the well completion apparatus downwardly or upwardly in the wellbore; and adding a fluid to the wellbore, or removing a fluid from the wellbore, wherein a decrease of the first and second pressures generates a force that is less than a sum of forces generated by the third pressure and the compressible member of the intermediate chamber, by a margin that exceeds the maximum strength of the first securing element, the force being operative for breaking the first securing element, thus allowing the compressible member to release its compressive force and move the lower piston downwardly to strike and break the second securing element, which releases the firing pin and allows the firing pin to apply a downward force to the percussion initiator to trigger the explosive reaction.

17. A method of using a firing head assembly in both a firing condition and a non-firing condition, the method comprising:

positioning a well completion apparatus including a perforating gun and the firing head assembly at a desired location within a wellbore, wherein the firing head assembly comprises:

a tubular housing having a first end, a second end, and a lumen extending between the first and second ends, an upper piston and a lower piston, wherein the upper piston is slidably disposed proximate to the first end of the tubular housing and the lower piston is slidably disposed proximate to the second end of the tubular housing, and each of the upper and lower pistons at least partially extend into the lumen of the tubular housing, a compressible member within the lumen of the tubular housing, wherein the compressible member has a first end portion in a contacting relationship with the upper piston, and a second end portion in a contacting relationship with the lower piston, the compressible member being operative for generating a compressive force and applying the compressive force onto the lower piston, a safety assembly comprising a sleeve and a key, the sleeve comprising a substantially zigzag-shaped slot having a plurality of stop points, wherein each stop point is spaced apart from an adjacent stop point, and wherein the key radially extends from an external surface of the upper piston through the zigzag-shaped slot, is slidably arranged within the zigzag-shaped slot, and is moveable between each of the stop points, a firing pin positioned below the lower piston, such that the lower piston is between the compressible member and the firing pin, a first securing mechanism securing the lower piston and secured to the lumen of the tubular housing at its second opening, wherein the first securing element is operative for restricting movement of the lower piston, and a percussion initiator positioned below the firing pin, the firing pin being retained in a spaced apart configuration from the percussion initiator by a second securing element, wherein the upper piston and the tubular housing at least partially define an upper chamber of the lumen above the upper piston, the lower piston and the tubular housing at least partially define a lower chamber of the lumen below the lower piston, and the compressible member is in an intermediate chamber between the upper chamber and the lower chamber, wherein the upper chamber has a first pressure, the lower chamber has a second pressure, and the intermediate chamber has a third pressure; and adjusting the first pressure and the second pressure to initiate an event, the event including one of triggering an explosive reaction in the firing condition, and canceling an explosive reaction in the non-firing condition wherein the adjusting comprises at least one of:

moving the perforating gun including the firing head assembly downwardly in the wellbore to increase the first pressure and the second pressure;

moving the perforating gun including the firing head assembly upwardly in the wellbore to decrease the first pressure and the second pressure;

adding a fluid to the wellbore to increase the wellbore pressure so that the first pressure and the second pressure are increased, and the compressible member is charged and generates a compressive force; and removing a fluid from the wellbore to decrease the wellbore pressure so that the first pressure and the second pressure are decreased, wherein a decrease of the first and second pressures is operative for releasing the lower piston from the first securing element, so that the lower piston moves downwardly to release the firing pin from the second securing element to allow the firing pin to apply a downward force to the percussion initiator to trigger an explosive reaction.

18. The method of claim 17, wherein:

the compressible member is operative for generating a compressive force and applying the compressive force onto the lower piston;

the lower piston is operative for contacting the firing pin to shear the second securing element, thus moving the firing pin downwardly towards the percussion initiator; and the firing pin is operative for applying a downward force to the percussion initiator to trigger the explosive reaction.

19. The method of claim 18, wherein the compressible member comprises a spring or a coil, and further wherein:

in the firing condition, the adjusting comprises:

increasing the wellbore pressure to adjust the compressible member to a compressed state and to move the key generally downwardly in the zigzag-shaped slot to a proximal stop point, thereby charging the compressible member so that the compressible member generates a compressive force;

decreasing the wellbore pressure to adjust the compressible member to a partially compressed state and to move the key generally upwardly in the zigzag-shaped slot to an intermediate position between the proximal and distal stop points; and further decreasing the wellbore pressure until the first and second pressures are less than the compressive force of the compressible member, the compressive force being greater than the maximum strength of the first securing element, wherein the compressive force breaks the first securing element, which releases the lower piston so that the lower piston breaks the second securing element, thus releasing the firing pin and allowing the firing pin to apply a downward force to the percussion initiator to trigger the explosive reaction; and in the non-firing condition, the adjusting further comprises:

further increasing the wellbore pressure to adjust the compressible member to a compressed state and to move the key generally downwardly in the zigzag-shaped slot to another proximal stop point, thereby charging the compressible member;

further decreasing the wellbore pressure to adjust the compressible member to a partially compressed state, which moves the key generally upwardly in the zigzag-shaped slot; and retrieving the perforating gun from the wellbore, wherein the retrieving of the perforating gun from the wellbore adjusts the compressible member to a relaxed state.

20. The method of claim 18, wherein the compressible member comprises a pressurized gas disposed within the intermediate chamber, and further wherein:

in the firing condition, the adjusting comprises:

increasing the wellbore pressure to compress the pressurized gas and to move the key generally downwardly in the zigzag-shaped slot to a proximal stop point;

decreasing the wellbore pressure to partially expand the pressurized gas and to move the key generally upwardly in the zigzag-shaped slot to an intermediate position between the proximal and distal stop points; and further decreasing the wellbore pressure until the first and second pressures are less than the third pressure, so that the third pressure generates a force onto the first securing element that is greater than the maximum strength of the first securing element, wherein the force breaks the first securing element, which releases the lower piston so that the lower piston breaks the second securing element, thus releasing the firing pin and allowing the firing pin to apply a downward force to the percussion initiator to trigger the explosive reaction; and in the non-firing condition, the adjusting further comprises:

further increasing the wellbore pressure to compress the pressurized gas and to move the key generally downwardly in the zigzag-shaped slot to another proximal stop point;

further decreasing the wellbore pressure to partially expand the pressurized gas, which moves the key generally upwardly in the zigzag-shaped slot; and retrieving the perforating gun from the wellbore which will further move the key upwardly in the zigzag-shaped slot to fully expand the pressurized gas.

* * * * *